US007154363B2

(12) United States Patent
Hunts

(10) Patent No.: US 7,154,363 B2
(45) Date of Patent: Dec. 26, 2006

(54) MAGNETIC CONNECTOR APPARATUS

(76) Inventor: Larry Dean Hunts, 451 Montclair, Eagle Point, OR (US) 97524

( * ) Notice: Subject to any disclaimer, the term of this patent is extended or adjusted under 35 U.S.C. 154(b) by 66 days.

(21) Appl. No.: 11/153,739

(22) Filed: Jun. 14, 2005

(65) Prior Publication Data

US 2006/0139134 A1 Jun. 29, 2006

Related U.S. Application Data

(60) Provisional application No. 60/639,005, filed on Dec. 23, 2004.

(51) Int. Cl.
*H01F 7/02* (2006.01)
*H01H 7/20* (2006.01)
*A63H 33/04* (2006.01)

(52) U.S. Cl. ..... 335/306; 335/285; 24/303; 446/92

(58) Field of Classification Search ..... 446/92, 446/137–139; 335/285, 306; 24/303; 273/239; 213/75 D See application file for complete search history.

(56) References Cited

U.S. PATENT DOCUMENTS 2,872,754 A * 2/1959 Cronberger ..... 446/92
3,303,606 A * 2/1967 Mann ..... 446/138
3,998,004 A * 12/1976 Ehrlich ..... 446/92
4,462,596 A * 7/1984 Yamamoto ..... 273/239
5,048,704 A * 9/1991 Takahashi ..... 213/75 D
5,347,253 A * 9/1994 Ogikubo ..... 335/302
5,746,638 A * 5/1998 Shiraishi ..... 446/92
6,024,626 A * 2/2000 Mendelsohn ..... 446/92
6,749,480 B1 * 6/2004 Hunts ..... 446/92
6,969,294 B1 * 11/2005 Vicentelli ..... 446/92

* cited by examiner

*Primary Examiner*—Ramon M. Barrera
(74) *Attorney, Agent, or Firm*—Olson & Olson

(57) ABSTRACT

A magnetic connector apparatus provides a plurality of magnetic connector bodies in various different forms for magnetic connection of two or more bodies together along mutually-confronting, longitudinally-elongated, linear peripheral border edges, each linear peripheral border edge having at least one particularly-configured longitudinally elongated, cylindrical magnet supported adjacent thereto for rotation of the magnet adjacent said peripheral edge of each connector body for orientation of the magnetic polarity of magnets of confronting connector bodies for mutual magnetic attraction along, mutually confronting, linear peripheral border edges of magnetic connector bodies.

6 Claims, 4 Drawing Sheets

MAGNETIC CONNECTOR APPARATUS

This application claims benefit under 35 U.S.C. 119(e) of the prior filing of U.S. Provisional Ser. No. 60/639,005 filed 23 Dec. 2004.

BACKGROUND OF THE INVENTION

This invention relates to magnetic connector arrangements, and more particularly to magnetic connector arrangements utilizing magnets retained rotatably in magnet containing pockets of multiple connector bodies provided for mutual magnetic attraction one to another, each respective magnet rotating in its pocket as needed for proper orientation and alignment of the respective opposite magnetic poles of the respective magnet as the connector bodies are moved toward each other and into magnetically-attracted connection one to another.

Such magnetic connector arrangements have been provided heretofore, as represented by the various structural arrangements and teachings of U.S. Pat. No. 5,347,253 to Ogikubo; U.S. Pat. No. 5,746,638 to Shiraishi; and my own earlier U.S. Pat. No. 6,749,480 issued 15 Jun. 2004. In this, each of the references teaches a different magnet connector structure for connecting multiple block-type bodies together in face-to-face abutment of selected panel side walls forming each body member.

In the first reference, Ogikubo provides a connector body arranged to contain a spherical magnet rotatably within its interior, for substantially universal rotation of the spherical magnet body on any diametric axis through the magnet for orientation of the opposite, north and south poles of the magnet as needed for proper magnetic attraction to a corresponding magnet of a second body member. The second reference identified above, Shiraishi provides a plurality of complex magnetically attracting, block-like hollow bodies with an internal, disc-type magnet structure associated with each side face wall of the block body, for mutual attraction of multiple such block bodies together in confronting, face-to-face abutment of selected side panels forming the multi-sided magnetic toy blocks. The last above-identified reference, my earlier U.S. patent, also provides a rather complex structural arrangement for rotatably supporting a magnetic body having opposite magnetic poles at its opposite longitudinal ends within a socket arrangement providing for universal rotation of the magnet therein, the magnet arrangement positioned substantially centrally of one or more side wall faces of multi-sided block-type bodies for magnetic connection of multiple block-type bodies together in face-to-face confrontation.

In each of these magnetically-attractable block-type body arrangements, the magnetic connector structure requires a structural configuration in which the dimension required for rotational movement of the magnet for polarity orientation is equal to or greater than the dimension providing for mutual magnetic attraction between confronting, oriented magnets of separate magnet bodies being secured together in magnetic connection.

While these various connector magnet structures may, as taught, be well suited for association with the panel face surfaces forming the side walls of multi-sided block-type magnetic connector bodies to be joined magnetically together in mutually aligned, sidewall-to-sidewall, face-to-face condition, they do not provide magnetic connector bodies nor connector magnet structures capable of or arranged for magnetic connection of multiple magnetic connector bodies in edge-to-edge condition along mutually confronting, linearly peripheral edges of the connector bodies.

SUMMARY OF THE INVENTION

In its basic concept this invention provides a plurality of magnetic connector bodies for magnetic connection together at mutually confronting, linear peripheral border edge surfaces thereof, each connector body having at least one outer, longitudinally extending, confronting linear peripheral border edge surface having at least one magnet pocket disposed adjacent thereto for rotatably supporting a longitudinally elongated, cylindrical magnet having its opposite magnetic poles occupying opposite diametric halves of the magnet throughout its length, the magnet pocket disposed adjacent the linear peripheral border edge surface for confronting, magnetic connection of multiple connector bodies together at mutually confronting, linear outer peripheral border edge surfaces of confronting, adjacent connector bodies.

It is by virtue of the foregoing basic concept that the principal objective of this invention is achieved; namely, the provision of a magnetic connector apparatus which provides for the connection of plural magnetic connector bodies together along mutually confronting, linear peripheral border edge surfaces thereof whereby to overcome the limitations and disadvantages of prior magnetic connector apparatus providing for the connection of multi-sided, block-type connector bodies together only in face-to-face condition of aligned planar side walls of the connector bodies.

Another object and advantage of this invention is the provision of a magnetic connector apparatus of the class described which provides a connector magnet arrangement providing a longitudinally elongated linear dimension of confronting magnet-to-magnet attraction surface while requiring a lesser, cross sectional diameter dimension for relative rotation of respective magnets for corresponding alignment of the magnetic poles of the magnets for mutual magnetic attraction one to another.

Another object and advantage of this invention is the provision of a magnetic connector apparatus of the class described in which magnetic connector bodies may be provided in many different shapes and forms including, but not limited to, block-type bodies, ring-type bodies and flat, panel type bodies arranged for magnetic connection one to another along respective confronting linear peripheral edges thereof.

Still another object and advantage of this invention is the provision of a magnetic connector apparatus of the class described which provides magnetic connector bodies which are particularly well suited for use for magnetic puzzles and games, toy building and construction sets and artistic sculpture and design kits, among many other uses.

A still further object and advantage of this invention is the provision of a magnetic connector apparatus of the class described which utilizes an extremely simplified connector magnet structure for economical manufacture and reliability and durability in use.

The foregoing and other objects and advantages of the present invention will appear from the following detailed description, taken in connection with the accompanying drawings of various preferred embodiments.

DESCRIPTION OF THE PREFERRED EMBODIMENTS

Figure 1:
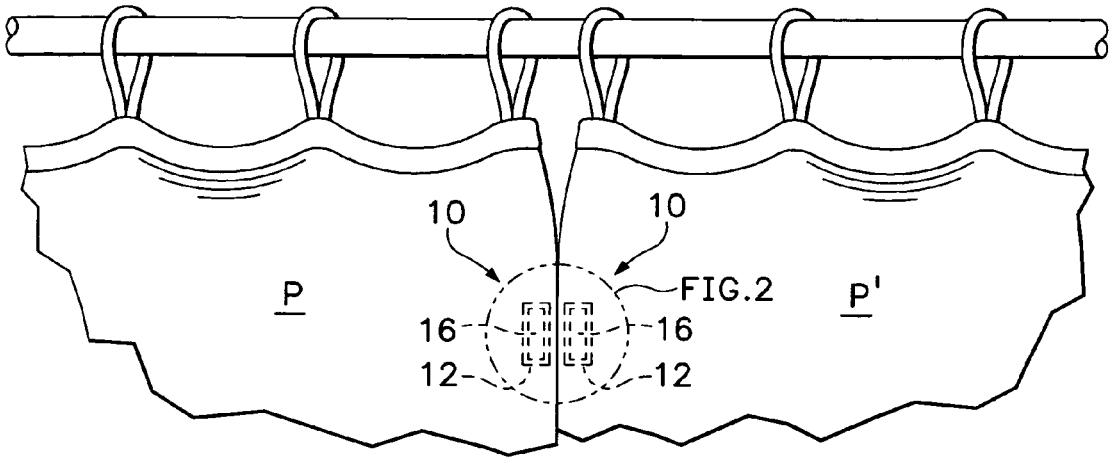
FIG. 1 is a fragmentary side elevation of a first, basic embodiment of the magnetic connector apparatus of this invention in use secured adjacent the opposite leading edges of a pair of drapes arranged to be magnetically secured together when drawn in a fully closed condition.
Figure 2:
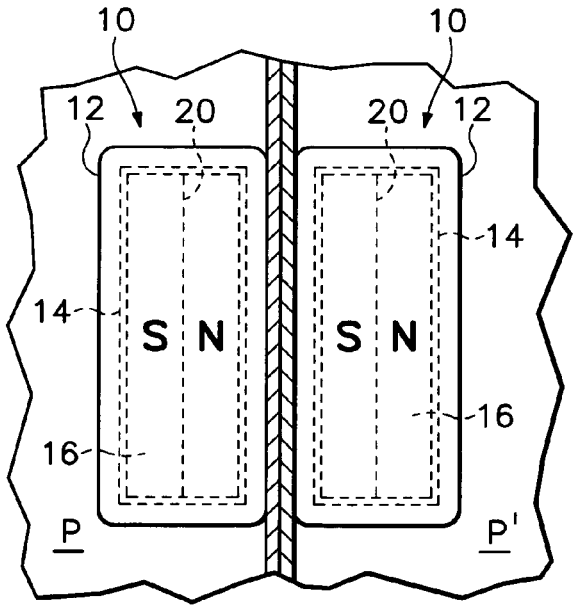
FIG. 2 is a side elevation, on a slightly enlarged scale, of the area encircled in broken lines in FIG. 1 and identified therein as FIG. 2.
Figure 3:
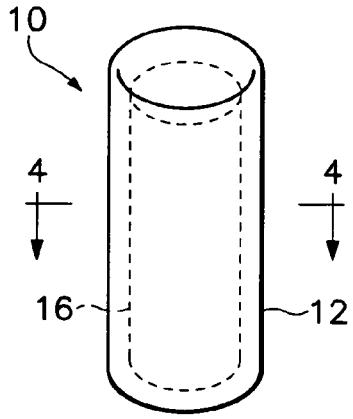
FIG. 3 is a perspective view of a single connector body of the connector apparatus of FIGS. 1 and 2.

A magnetic connector apparatus embodying features of the present invention is illustrated herein in various different illustrative embodiments, each embodiment utilizing the basic, essential structural elements unique to this invention as will now be described in detail. FIGS. 1–3 illustrate a first embodiment of the magnetic connector apparatus of this invention, the connector apparatus comprising at least two magnetic connector bodies 10 (a pair being shown herein), provided for mutual magnetic attraction along adjacent on confronting, linear peripheral border edges thereof to each other. FIG. 3 is a perspective view showing a single connector body of the first embodiment in detail, while FIGS. 1 and 2 are schematic illustrations of a pair of connector body members 10 forming a connector apparatus shown in a working environment wherein the magnetic connector bodies are secured on a pair of drapery panels P, P' adjacent their respective confronting free ends, whereby to positively draw the confronting ends of the drapery panel together when the drapes are closed.

As will become evident from the following detailed description and various illustrations of preferred embodiments, the magnetic connector apparatus of this invention provides magnetic connector bodies 10, 10*a*–*f* which, although they may be provided in widely diverse overall forms and arrangements, each are arranged with at least one longitudinally-extending, outer peripheral magnet-containing linear, peripheral confronting border edge of the connector body for confronting disposition with a corresponding, linear peripheral border edge of another connector body, for mutual magnetic attraction and connection of multiple connector bodies together along mutually-confronting, linear peripheral border edges of the respective connector bodies.

In this regard, and as seen best in FIGS. 2 and 3, each connector body 10 of this first embodiment provides a single longitudinally elongated, linear leg 12 here shown in the form of a longitudinally elongated tubular member having a substantially hollow portion intermediate the longitudinal ends of the leg member The hollow portion is configured as a longitudinally elongated magnet-receiving pocket 14 arranged to receive and retain a particularly-configured, longitudinally elongated, cylindrical magnet 16 for rotation therein about the longitudinally extending axis of the diametric centerline through the length of the cylindrical magnet. As seen in each of the drawings herein, the centerline axis of rotation is aligned substantially parallel to the longitudinal line of extension of the longitudinally elongated linear leg 12 and closely adjacent the linear peripheral border edge of the leg providing a longitudinally elongated, linear peripheral border edge of the connector body, as shown. As also seen best in FIGS. 2 and 3, the magnet pocket 14 shown in this particular embodiment of the invention is arranged to occupy a substantial portion of the length of the linear leg 12. However, as illustrated in other embodiments of the invention, the magnet pocket may alternatively be arranged to occupy a smaller relative length portion of the associated leg, as well as include the provision of multiple, longitudinally spaced apart magnet-containing pockets 14 contained within a single leg 12, as will be discussed later.

As seen in the drawings, the magnet pocket 14 is configured to receive a longitudinally elongated cylindrical magnet body 16 and retain it for substantially free, unrestricted rotation of the magnet in the pocket while also confining the magnet in position longitudinally on the leg member 12. In this regard, numerous alternative magnet pocket arrangements may be provided to support the cylindrical magnet 16 for free rotation, as is shown by the various illustrative internal magnet pocket configurations 14, 14*a*–*e* shown in FIGS. 4–9 of the drawings.

Figure 4:
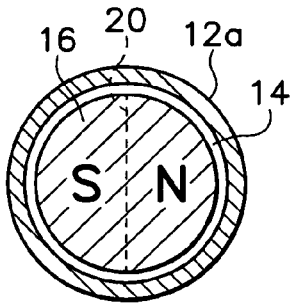
FIG. 4 is a sectional view through the connector body of FIG. 3 taken along the line 4—4 in FIG. 3.
Figure 5:
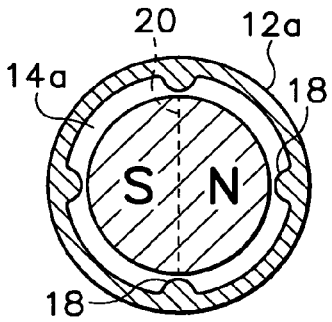
FIGS. 5 and 6 are sectional views, similar to that of FIG. 4, but illustrating different, alternative internal magnet pocket configurations arranged for supporting the cylindrical magnet for free rotation within the magnet pocket of a linear leg of a connector body.

FIG. 4 illustrates that a magnet containing pocket 14 may be formed with a substantially smooth cylindrical interior surface having a length and diameter slightly greater than the corresponding external length and diameter, respectively, of the magnet 16 contained for rotation therein. FIG. 5 illustrates that a magnet-containing pocket 14*a* may include inwardly-extending protrusions 18 arranged to provide reduced contact area bearing surfaces for confining the magnet for rotation therebetween. FIGS. 6–9 illustrate that the inner surface configuration of a magnet containing pocket may alternatively be provided in other geometric cross sections such as a square cross section 14*b*, 14*c* (FIGS. 6, 7); a triangular cross section 14*d* (FIG. 8); and many-walled cross section 14*e* (FIG. 9) arranged to provide rotatable confinement of the cylindrical magnet 16 by a plurality of flat confining walls as shown. Any other pocket configuration that permits free, substantially unrestricted confined rotation of the magnet within the magnet pocket may be utilized alternatively as may be desired.

Figure 6:
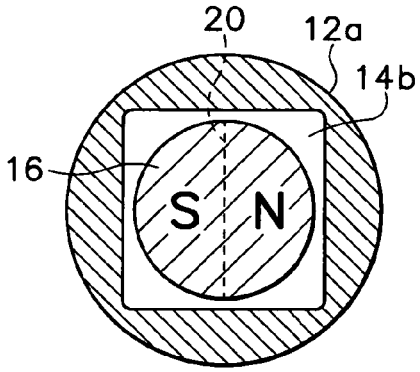
Figure 7:
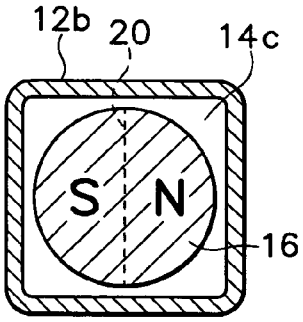
FIGS. 7, 8 and 9 are sectional views generally similar to that of FIG. 4, but illustrating various different, alternative external configurations of the linear legs of connector bodies.
Figure 8:
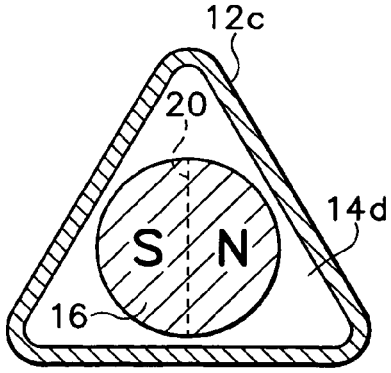
Figure 9:
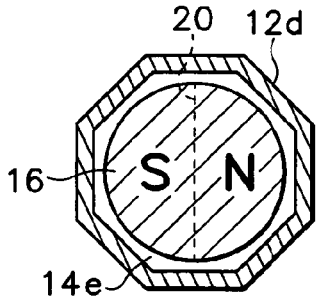

FIGS. 4–9 further illustrate that the exterior surface of the linear, legs 12 of connector bodies may also be arranged with virtually any desired external cross sectional configuration as may be needed or desired for various connector bodies. In this regard, a longitudinally elongated, linear leg 12 may have a uniform cylindrical external peripheral surface 12*a* as shown in FIGS. 4–6, or legs may have external surface configurations formed of three or more peripheral linear edges, as illustrated by the square tube configuration 12*b* of FIG. 7, and the triangular tube configuration 12*c* of FIG. 8 and the octagonal tube configuration 12*d* of FIG. 9. As will be readily apparent to those skilled in the art, irrespective of the particular exterior surface configuration of the longitudinally elongated, linear peripheral leg, each leg provides at least one longitudinally extending, exterior linear peripheral border edge surface of the connector body for confronting disposition with a corresponding linear peripheral border edge surface of a peripheral linear leg of another magnetic connector body being magnetically connected together.

Of critical importance to the present invention is the particular, required configuration of the particular magnet body 16 contained in the aforementioned magnet pocket 14 disposed adjacent each peripheral linear confronting border edge of each connector body 10 as will now be explained. In this, and as discussed briefly earlier, the magnet 16 is specifically provided in the form of a longitudinally elongated cylinder having a selected, longitudinal length dimension that is greater than its selected uniform diameter dimension, the magnet body arranged for rotatable containment within the particular, corresponding magnet pocket 14 provided in a linear leg 12 of the connector bodies thus far described.

As seen best in viewing FIGS. 2 and 4 of the drawings, the opposite, north N and south S poles of the magnet are specifically and essentially arranged to occupy opposite diametric halves of the cylindrical magnet body throughout its full, entire length, divided as by an imaginary plane 20 dissecting the magnet diametrically along the longitudinal center line extending lengthwise through the center of the magnet body and effectively dividing the body into two opposite, substantially identical full-length diametric halves having opposite magnetic polarities as shown clearly in the vertical and horizontal sectional views through the magnet shown in FIGS. 2 and 4 respectively.

Thus, as will be readily apparent to those skilled in the art, as the linear legs 12 of two magnetic connector bodies 10 are moved toward and into confronting, closely adjacent position with each other, as shown in FIGS. 1 and 2, the magnets 16 rotate freely within their respective magnet pockets 14 in order to position the poles N, S of the magnets in mutually magnetically-attracting opposition to each other, as clearly shown in FIG. 2. In this position, the full length of the confronting, linear surface area of each magnet is utilized in the magnetic connection while rotation of the magnets for polarity alignment is about the axis of the diameter of the magnet. This provides for greatest magnet to magnet linear attraction surface area while also allowing the leg members and connector bodies to require only a minimal, cross sectional dimension for rotational movement of the magnet body within the magnet pocket of the leg for polarity alignment with the magnet of another connector body. It is this particular and unique magnet configuration and peripheral edge placement that allows for magnetic connection of multiple connector bodies together along confronting linear peripheral edges of the connector bodies.

FIGS. 1 and 2 illustrate an example of the first embodiment (FIG. 3) of the connector apparatus of the invention in use affixed to the leading edge portions of a pair of drapery panels P, P'. In this, a pair of magnetic connector bodies 10 each having a single linear leg 12 are positioned in vertically extending condition on a pair of drapery panels P, P' adjacent their leading terminal edges, the connector bodies positioned for confronting disposition with each other when the drapery panels are in their closed position shown. The connector bodies 10 may be attached to the draperies in any manner as may be desired, such as by confining them within pockets (not shown) in the fabric, hot gluing the connector bodies to the fabric, or by any other suitable means of attachment as may be desired. Also, the bodies may be formed with a projecting tab (not shown) or other structure for other securement, e.g. rivet or other fastener, to the drape fabric as will be appreciated.

As is readily evident, as the drapery panels are moved from their open, separated position toward their closed, leading edge-abutting condition shown in FIGS. 1 and 2, the magnets 16 of each connector body will rotate within their confining pockets 14 in the legs 12 as needed to orient their respective poles N, S into facing, magnetically mutually-attractive position in which their respective opposite poles confront each other, as shown in FIG. 2. This arrangement provides for magnetic connection of the leading edges of the drapes to assure their complete closing against the passage of light therebetween, and permits their separation when the drapes are opened and the pull of the opening drapes overcomes the magnetic attraction of the particular magnetic coupler arrangement. As will be apparent, in this example, the positioning and attachment of the corresponding magnetic connector bodies relative to the leading edges of the drapery may be selected as needed, as for example in the case of drapery panels that are arranged to slightly overlap each other in fully closed condition.

Additional illustrative embodiments of the magnetic connector apparatus of this invention are shown in FIGS. 10, 11, 12 and 14 wherein it can be seen that connector bodies may also include more than a single linear peripheral leg as has been described hereinbefore in connection with the embodiment of FIGS. 1–3. This is shown in various additional illustrative embodiments of different, ring type magnetic connector bodies 10*a*–10*d*.

Figure 10:
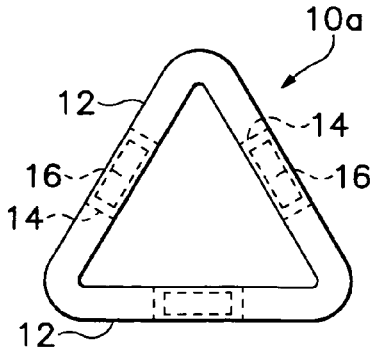
FIG. 10 is a top plan view of another embodiment of the magnet connector apparatus of this invention providing a connector body formed as a ring member having three peripheral, magnet-containing linear legs connected together angularly in end-to-end connection and forming outer peripheral linear border edges of the connector body.
Figure 11:
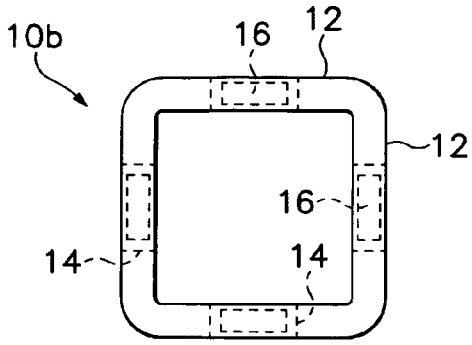
FIG. 11 is a top plan view of another embodiment of a connector body in the form of a ring member having four peripheral magnet-containing linear legs forming peripheral linear confronting border edges of the connector body.
Figure 12:
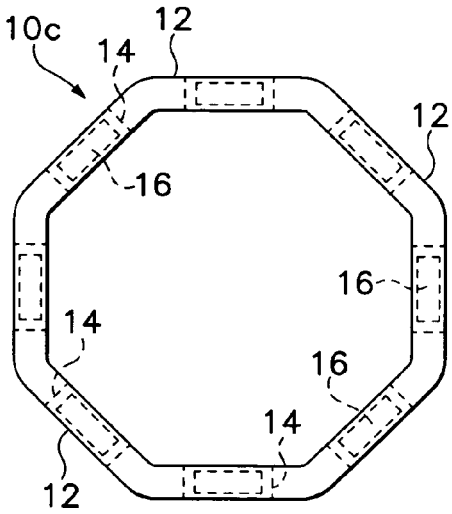
FIG. 12 is a top plan view of another embodiment of a connector body in the form of a ring member having eight peripheral magnet-containing linear legs forming peripheral linear confronting border edges of the connector body.

FIG. 10 illustrates a magnetic connector body 10*a* having three linear magnet containing legs 12 secured in end-to-end condition with the longitudinal line of extension of each linear leg arranged to extend angularly relative to the longitudinal line of extension of the leg to which its ends are connected, the three legs connected together forming a substantially triangular, ring-type connector body 10*a* formed by the peripheral, linear legs. FIGS. 11 and 12 illustrate connector bodies 10*b*, 10*c* having four and eight linear peripheral linear legs 12, respectively, connected together in end-to-end, angularly extending condition forming ring connector bodies.

Figure 14:
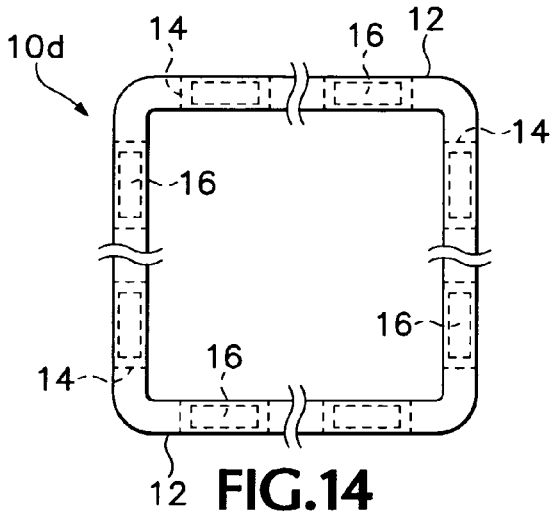
FIG. 14 is a foreshortened, top plan view of a connector body having four peripheral linear legs and showing that the linear legs may each contain more than one magnet-containing pockets spaced longitudinally apart along the elongated linear legs.

FIG. 14 is a foreshortened plan view of a four leg ring-type connector body 10*d* showing that each linear peripheral leg 12 of a connector body may, if needed or desired, incorporate more than one longitudinally-spaced apart magnet-containing pocket 14 and associated magnet 16. This arrangement may be advantageous for many reasons, as for example in the case of large size connector bodies, or to reduce a possibility of relative twisting or other relative movement of connected connector bodies, or for other needs, purposes or benefit in the edge-to-edge surface connection of plural magnetic connector bodies one to another.

Figure 15:
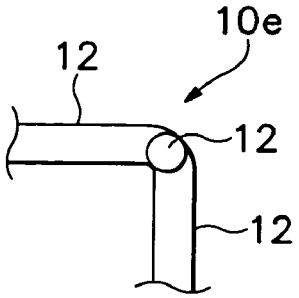
FIG. 15 is a fragmentary top plan view of another embodiment of a connector body arrangement.

Further, although the connector bodies 10*a*–10*d* are illustrated herein as occupying only a single plane and forming a connector body in the form of a ring member, those skilled in the art will recognize from FIG. 15 that peripheral linear legs 12 may additionally extend in end-to-end connection angularly on other planes or axes intersecting the plane of other connected legs, whereby to form block type connector bodies 10*e*, or connector bodies occupying more than a single plane, arranged for magnetic connection along linear peripheral edges thereof as apparent.

Figure 13:
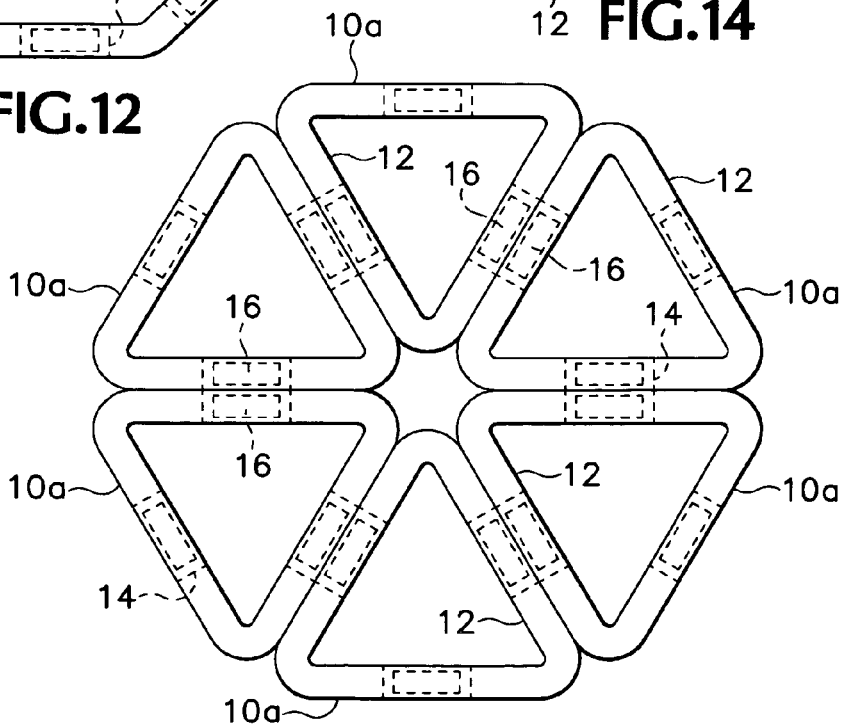
FIG. 13 is a top plan view of a plurality of connector bodies of FIG. 10 magnetically secured together in a laid-flat, edge-to-edge condition along mutually confronting, peripheral legs of the connector bodies.
Figure 16:
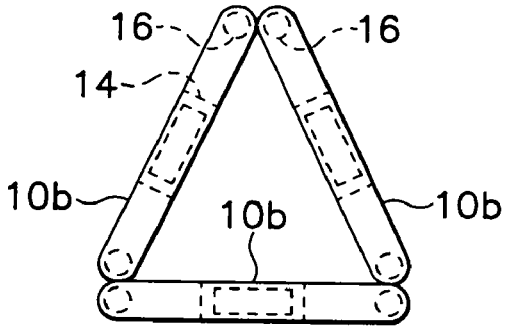
FIG. 16 is a side elevation of a plurality of the connector bodies 10*b* of FIG. 11 magnetically connected together to form a three-dimensional pyramid assembly of ring members.

FIG. 13 illustrates a plurality of the ring type connector bodies, represented herein by the example of connector bodies 10*a* of FIG. 10, in one, peripheral edge-to-edge connected condition in an illustrative example of a magnetic puzzle game formed by the connector apparatus of this invention. FIG. 16 illustrates that ring type connector bodies, represented by bodies 10*b* of FIG. 11, may also be arranged in different, alternative peripheral edge-to-edge connection condition in a puzzle game arrangement.

In the illustrative embodiments of the multi-leg ring-type connector bodies formed by a plurality of end-connected peripheral, linear legs as seen in FIGS. 10–12 and 14, the central area inbetween the peripheral legs 12 is illustrated in these embodiments as being hollow and open, forming an open-center ring connector body. While the multi leg connector bodies of this invention have heretofore been described and illustrated herein in various ring type forms having peripheral linear legs forming ring bodies having hollow, open interiors therebetween, it will be readily apparent to those skilled in the art that alternatively, the interior space between the peripheral legs of the connector bodies may be occupied as by panels or other arrangement as may be desired for the purpose of the connector body.

Figure 17:
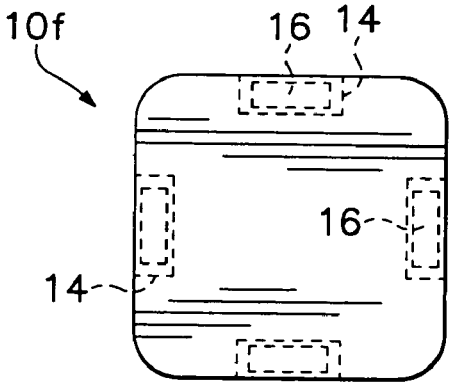
FIG. 17 is a top plan view of yet another embodiment of a connector body of this invention provided in the form of a flat panel member having four magnet-containing pockets disposed adjacent the peripheral linear border edges of the panel body.
Figure 18:
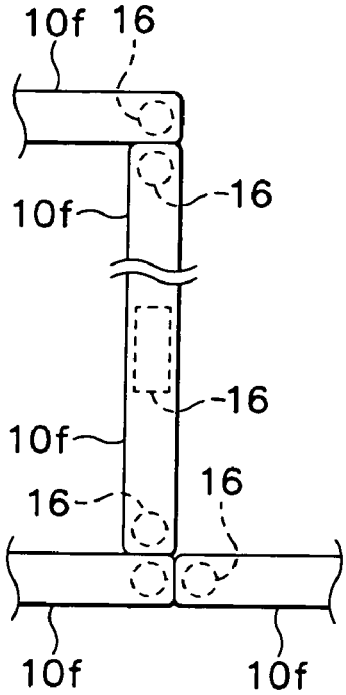
FIG. 18 is a foreshortened, fragmentary side elevation of a plurality of panel members of FIG. 17 connected together in an illustrative edge-to-edge arrangement.

In this regard, FIGS. 17 and 18 illustrate this arrangement in the form of another embodiment of a multi leg connector body 10*f*, generally similar to the four leg ring type connector body 10*b* of FIG. 11, but here provided as a flat panel member formed, in this example, with four magnet-containing magnet pockets disposed adjacent the four outer, confronting, longitudinally-extending linear peripheral border edges of the magnetic connector panel body, as seen best in FIG. 17. Those skilled in the art will recognize that panel bodies may also be provided in other than four peripheral edge form as well, just as is shown by the various plan views of FIGS. 10–12, 14 showing different, multi peripheral edge ring bodies. FIG. 18 shows an example of a plurality of magnetic connector panel bodies 10*f* arranged in peripheral edge-to-edge magnetic connection along confronting peripheral linear border edge surfaces of adjacent connector panel members. In this manner, magnetic connector panel bodies, as well as magnetic connector ring bodies and other forms of magnetic connector bodies encompassed in this invention may as an example be provided as magnetic connector pieces for magnetic puzzles and games as well as for toy building and artistic sculpture kits, etc. for creative play, educational and many other valuable uses, functions and purposes.

From the foregoing it will be apparent to those skilled in the art that many various changes, other than those previously described or mentioned, may be made in the size, shape, type, number and arrangement of parts described hereinbefore without departing from the spirit of this invention and the scope of the appended claims.

Having thus described my invention and the manner in which it may be used, I claim:

1. A magnetic connector apparatus, comprising:

a) at least two magnetic connector bodies each arranged for magnetic connection one to another along mutually confronting linear outer peripheral border edges of the connector bodies, each said magnetic connector body including at least one outer, confronting, longitudinally extending, linear peripheral border edge, b) each said connector body having at least one magnet pocket positioned adjacent each said at least one outer confronting, longitudinally extending linear, peripheral border edge of the magnetic connector body, and c) a longitudinally extending, cylindrical magnet in each said at least one magnet pocket of each said body member, each said magnet arranged with opposite magnetic poles occupying opposite diametric halves of the cylindrical magnet throughout its entire longitudinal length, each magnet supported in a magnet pocket for rotation therein about the longitudinally-extending axis of the diametric center line through the longitudinal length of the magnet, said axis of rotation extending substantially parallel to said longitudinally extending, linear peripheral border edge of the connector body.

2. The magnetic connector apparatus of claim 1 wherein at least one of said at least two connector bodies includes a plurality of said outer, confronting, longitudinally extending, linear peripheral border edges each having at least one magnet pocket positioned adjacent thereto.

3. The magnetic connector apparatus of claim 1 wherein each said magnetic connector body includes at least one peripheral, longitudinally-elongated, linear magnet pocket-containing leg, each leg providing at least one said outer, confronting, longitudinally-extending, linear peripheral border edge of the magnetic connector body.

4. The magnetic connector apparatus of claim 3 wherein at least one of said at least two magnetic connector bodies includes at least two said longitudinally elongated, magnet-containing peripheral linear legs fixedly connected together at confronting longitudinal ends for longitudinal extension of the connected linear legs angularly relative to each other, each of at the least two angularly-connected linear legs providing a confronting, longitudinally extending, linear peripheral border edge of the magnetic connector body.

5. The magnetic connector apparatus of claim 4 wherein said at least one magnetic connector body includes at least three longitudinally-elongated, magnet containing peripheral linear legs connected in longitudinal, end-to-end condition for longitudinal extension of each connected linear leg angularly relative to the other to form a multi-leg magnetic connector ring body with each said linear peripheral leg providing an outer peripheral linear border edge of said ring body.

6. The magnetic connector apparatus of claim 1 wherein at least one of said at least two magnetic connector bodies comprises a flat connector panel body having a plurality of said outer, confronting, longitudinally-extending, linear peripheral panel border edges.

* * * * *